US005454206A

United States Patent [19]

Bailer et al.

[11] Patent Number: 5,454,206

[45] Date of Patent: Oct. 3, 1995

[54] APPARATUS FOR THE SIMULTANEOUS INTRODUCTION OF PRODUCT AND PACKAGING INSERT INTO A CONTAINER

[75] Inventors: Rudolf Bailer, Laupheim; Fritz Fochler, Senden; Bernd Kleinstäuber, Burgrieden; Reinhold Ruf, Laupheim, all of Germany

[73] Assignee: Uhlmann Pac-Systeme GmbH & Co. KG, Laupheim, Germany

[21] Appl. No.: 203,772

[22] Filed: Feb. 28, 1994

[30] Foreign Application Priority Data

Feb. 27, 1993 [DE] Germany ..... 43 06 170.2

[51] Int. Cl.[6] ..... B65B 5/08; B65B 35/54; B65B 39/14

[52] U.S. Cl. ..... 53/157; 53/238; 53/252; 53/258

[58] Field of Search ..... 53/117, 157, 238, 53/252, 258, 251, 566

[56] References Cited

U.S. PATENT DOCUMENTS 3,982,382 9/1976 Vogel ..... 53/252

5,081,816 1/1992 Cardinali ..... 53/157 X

FOREIGN PATENT DOCUMENTS 3341573 9/1984 Germany .

1584162 2/1976 United Kingdom ..... 53/157

*Primary Examiner*—Linda Johnson

*Attorney, Agent, or Firm*—Herbert Dubno

[57] ABSTRACT

An apparatus for the insertion of products of various sizes from a product conveyor into containers on a container conveyor has an insertion chain of carriages whose rams are controlled by endless cams along the carriage travel path. The hold-down tongues on hold-down rods are mounted on slides which are guided on posts of the carriages and controlled by a slide cam and a rod cam on a cam carrier which is split for size adjustment upon movement of a moveable carrier to vary the positions of these cams at the insertion region of the chains when products of different sizes are to be inserted in the boxes.

16 Claims, 8 Drawing Sheets

APPARATUS FOR THE SIMULTANEOUS INTRODUCTION OF PRODUCT AND PACKAGING INSERT INTO A CONTAINER

FIELD OF THE INVENTION

Our present invention relates to an apparatus for the simultaneous introduction of a product (one or more articles to be packaged) and packaging inserts (usually brochures, descriptive tickets or slips or product information sheets or leaflets) into box-shaped containers. More particularly the invention relates to the packaging of stacks of blister packs, strip packs or the like and leaflet, brochures or inserts, like bipack tickets, into box-like containers, especially boxes which have been erected from folded blanks, in succession.

BACKGROUND OF THE INVENTION

Machines for the packaging of products by the simultaneous introduction of a product, especially a stack of blister packs, strip packs or the like, and brochures or leaflets like bipack tickets, into box-like containers erected from folded container blanks, can utilize an endless product-transport chain delivering the product to the packaging location, a continuous product-insertion chain provided with the mechanism for displacing the product into the container, and an endless container-transport chain, these chains having at least portions of their respective stretches which are parallel to one another and synchronized with one another.

The package-insertion chain can lie along a side of the product-transport chain opposite that along which the container transport chain is provided and can be equipped with means for shifting the product transversely to the chain travel direction into the container. Such means can include insertion rams which cannot only displace the product but also the brochures, leaflets or bipack tickets, hereinafter referred to as packaging inserts, into the container.

The machine can be provided with hold-down means which can be shiftable together with the insertion ram and can have slides controlled by cam-follower rollers engaging in closed cam tracks.

Apparatus of this type, wherein the product is delivered to the packaging location in cells of the product transport chain and in which the product and the product insert are transferred into respective containers in cells of the container-transport chain generally provide the two chains such that the cells can align and the transfer is effected cell by cell.

A typical apparatus of this type is described in DE 33 41 573 A1.

In the latter system, the hold-down tongues serve to press the product downwardly prior to the shifting of the product into the boxes by pressing on the product from above to maintain the shape of the product and to prevent detrimental deformation of the product during the product insertion process.

The hold-down plungers themselves are provided on slides which can be connected together to form an independent endless chain which can be driven in addition to the chains mentioned above at least partially above the common portion of the pass of the other chains at which the product-transport chain, the container-transport chain and the insertion chain are juxtaposed and synchronously moved. The slides are so provided that the hold-down tongues can be lowered onto the product before the latter is shoved into the container.

The drawback of this system is that the product-transport chain and the chain formed from the sliders of the hold-down tongues must be accurately synchronized since even small travel differences between these chains can result in offsetting between the carriages and the sliders and result in interference with the product-insertion process. In addition, problems arise with respect to the insertion of products of different dimensions since it is either not possible to alter the sizes accommodated by the machines with such apparatus or the alteration of the apparatus for different product sizes is difficult or complex because the slider-forming chain must be adjusted as an entity without interfering with the synchronization between this chain and the other chains.

OBJECTS OF THE INVENTION

It is, therefore, the principal object of the present invention to provide an improved apparatus for the simultaneous introduction of products and product inserts into containers, especially erected boxes, which is of simplified construction and operation, is more reliable than earlier systems and can be adjusted to different sizes of the products to be packaged.

Another object of this invention is to provide an improved packaging machine, especially for stacks of blister packs or the like and which has simplified adjustment to product height.

It is also an object of this invention to provide a packaging machine which is free from drawbacks of prior art packaging equipment, especially with respect to the adjustability of the apparatus to the height of the product to be packaged.

SUMMARY OF THE INVENTION

These objects and others which will become apparent hereinafter are attained, in accordance with the invention by providing the cam track for the control of the rods on which the hold-down tongues are carried and the cam track for the sliders on which these rods are displaceable so that over their entire lengths they follow the travel of the insertion ram carriages on the insertion chain but are provided on a cam carrier which is subdivided into at least two parts, at least one of these parts, corresponding to that along which the tongues travel coinciding with the product-insertion region of the chains being shiftable relative to the other for adjustment as to the product size. The adjustable part of the cam carrier can be shifted in a direction which is perpendicular to the direction of travel of the carriages in this region and to the longitudinal directions of the rods carrying the hold-down tongues.

According to a feature of the invention, at least one guide column is provided on each of the carriages and extends substantially perpendicular to the direction of travel thereof and to the longitudinal dimension of the hold-down rods, to form guides for the sliders and along which the cams are adjustable.

Furthermore, the displacement of the rods is greater by at least the width of the product-transport chain than the product-insertion stroke of the product into the container, i.e. than the stroke of the insertion ram, by at least the width of the product-transport chain.

More particularly, an apparatus for the simultaneous introduction of a product and a packing insert into a box-shaped container can comprise:

an endless product transport chain carrying a succession of products to be packaged in the containers;

an endless container transport chain disposed on one side of the product transport chain and carrying a succession of the containers for receiving the products and inserts;

an endless product pusher chain disposed on an opposite side of the product transport chain, the chains having mutually an endless product pusher chain disposed on an opposite side of the product transport chain, the chains having mutually parallel stretches synchronized for movement at least over a region at which a product from the product transport chain is inserted together with an insert into a respective container, the product pusher chain comprising:

a plurality of interlinked carriages, a respective pusher ram shiftable on each carriage and shiftable transversely to the movement of the chains in the region and aligned with a product on the product transport chain and with a container on the container transport chain for shifting the respective product into the respective container, and at least one guide column formed in each of the carriages;

hold-down means for engaging the products and including:

a respective hold-down tongue at each carriage engageable with a respective product from above during shifting of the respective product, a respective hold-down rod shiftable parallel to the pusher and carrying the respective hold-down tongue, a respective slider assigned to each carriage, movable parallel thereto and synchronously with the carriages at least in the region, the slider slidably receiving the respective hold-down rod, the sliders having a circulating path and each being provided with a cam-follower roller engaged in a first slave cam extending in a closed path along the circulating path, the sliders being guided on the columns for movement perpendicular to the rods and the carriages in the region, a respective cam-follower roller on each of the hold-down rods engaged in a second slave cam for controlling the respective hold-down tongue, the cams following a path of the carriages over the length thereof, a common cam carrier for the cams, the cam carrier being subdivided into at least two parts, at least one of the parts extending over the region, adjusting means operatively connected to the one of the parts for shifting same in a direction perpendicular to the rods and to the direction of movement of the carriages in the region for adjusting the tongues to different product sizes, the rods having an insertion pusher ram by at least a width of the product transport chain; and means for positioning the inserts ahead of the pusher rams in the region.

With the invention, therefore, the sliders which are guided on the carriages which the respective guide columns thus move together with the carriages and the insertion chain, thereby ensuring exact orientation of the sliders with the carriages throughout the travel of the carriages along their closed paths. The sliders need not be provided in a separate chain nor is a separate drive required for the sliders having the hold-down tongues mounted thereon. For size adjustment upon a change in the height of the product to be packages, i.e. in the number of blister packs in a stack to be packaged, the moveable cam-carrier part can be adjusted relative to the other or stationary cam-carrier part, thereby shifting the sliders correspondingly along the guide columns of the carriages. As a consequence, the total length of the travel path of the sliders can be altered for the size change but this alteration is not of significance with respect to the synchronization with the carriages because of the independence of the sliders from one another and the fact that they are guided on the respective carriages.

Of course the lengths of the guide columns should be at least equal to the adjustability of the height of the sliders.

In addition, the greater stroke of the hold-down rods ensures that, where the insertion chain approaches the product-transport chain, or withdraws therefrom in the travel of the chains, the hold-down tongues will be withdrawn from the product chain in a direction turned away from the container-transport chain so that they cannot collide with the product-transport chain.

In a preferred configuration of the invention, the two cams are bridged between the two relatively shiftable cam-carrier parts by connecting members which overlap in the direction of travel of the cam followers along these parts and allow the displacement of the moveable part relative to the stationary part while bridging any gaps for the respective cam-follower roller.

Thus the connecting pieces between these parts interconnect respective portions of the first and second cams to maintain continuity thereof.

At junction of at least one of the parts with one of the connecting pieces, the respective connecting piece has a U-shaped cross section received in a U-shaped cross section of the respective part, the respective cam-follower roller having a width such that it rides upon opposing surfaces of both of the cross sections in traversing the junction.

The first cam is formed in the one of the parts with a dip causing a parallel shifting of the sliders relative to the carriages, the dip being located at a portion of the region at which the respective tongues are disposed above the products before the products have been inserted into the containers, the second cam having a width in a direction of axes of the respective cam-follower rollers at least equal to the parallel shifting of the sliders by the dip.

The cam can be so formed that the respective cam-follower rollers are constrained to follow the cams without substantial play over entire lengths of the cams.

Advantageously, each of the cams is formed by opposite flanks of a respective guide groove receiving the respective cam-follower roller.

With this arrangement of flush surfaces of the connecting or bridging pieces and the cam surfaces, a uniform gap-free travel of the cam followers can be effected at the transitions between the cam sections and the bridge pieces.

The dip allows a parallel shift of the sliders in a direction toward the carriages with the dip being located at a part of the transfer region at which the tongues engage products before they are inserted into the containers. The second cam, as mentioned, has a width accommodating the adjustment travel.

Advantageously, each carriage has a pair of guide columns upon which the slides are mounted, this preventing in a simple way the twisting of the sliders around axes of the guide column.

The adjusting means can include a height-variable spindle interposed between the cam-carrying parts and a sensor can be operatively connected with the moveable part for detecting an adjustment setting thereof, the sensor being connected to means for displaying the setting, thereby simplifying adjustment, improving reproducibility thereof and allowing control.

The size compensation for the dimensions of the product can also be effected in the direction of insertion of the product into the container. This size adjustment can be achieved in a simple manner by providing a portion of the section of the second cam which is effective during the insertion movement so that it is replaceable or exchangeable on an adjustable cam-carrier part forming a size-adjusting part. The size adjustment can thus be effected by replacement of the replaceable part for another corresponding to the size of the product to be packed.

Replacement is facilitated by providing the replaceable sizing part on a pivotal plate which is swingable about an axis parallel to the direction of movement of the carriages and secured in the respective pivotal positions by an indexing pin. The part of the cam on the sizing part can be selected to be flush with the remainder of the cam in all cases. When the pivotal plate is swung out of its operative position, the sizing part is especially accessible for replacement.

Further, the sizing part can be divided along the cam and a transverse to the longitudinal direction of the hold-down rods. The portion of the sizing part turned away from the product to be packaged can be arranged on an overload slider displaceable in the longitudinal direction of the hold-down rods on the pivotal plate.

The overload slider can be biased by a resilient member, especially a pneumatic or hydraulic cylinder, for holding it in a working position relative to the product to be packaged.

If a blockage of the product prevents it from being shifted into the container so that the hold-down rods can no longer be displaced in the longitudinal direction, the overload slider prevents damage since it allows a portion of the cam to move in the opposite direction under the forces applied to the rods and therefore limits the effect of the obstruction. The force against which the overload slider can move is the resilient force which, as indicated, can be provided by a pneumatic or hydraulic cylinder.

The machine can be so constructed that at the start of the insertion region, the second cam can have a branch or bypass connected to the second cam via a transition-cam region and which bridges the introductory region at the start of the product-insertion operation. The branch then is connected at its downstream side to the cam. In the case of omitted product, omitted containers or omitted product inserts, by corresponding actuation of the branching path, the insertion operation is prevented with the cam-follower rolls traveling along the bypass and preventing the hold-down rods from being shifted toward the container transport.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
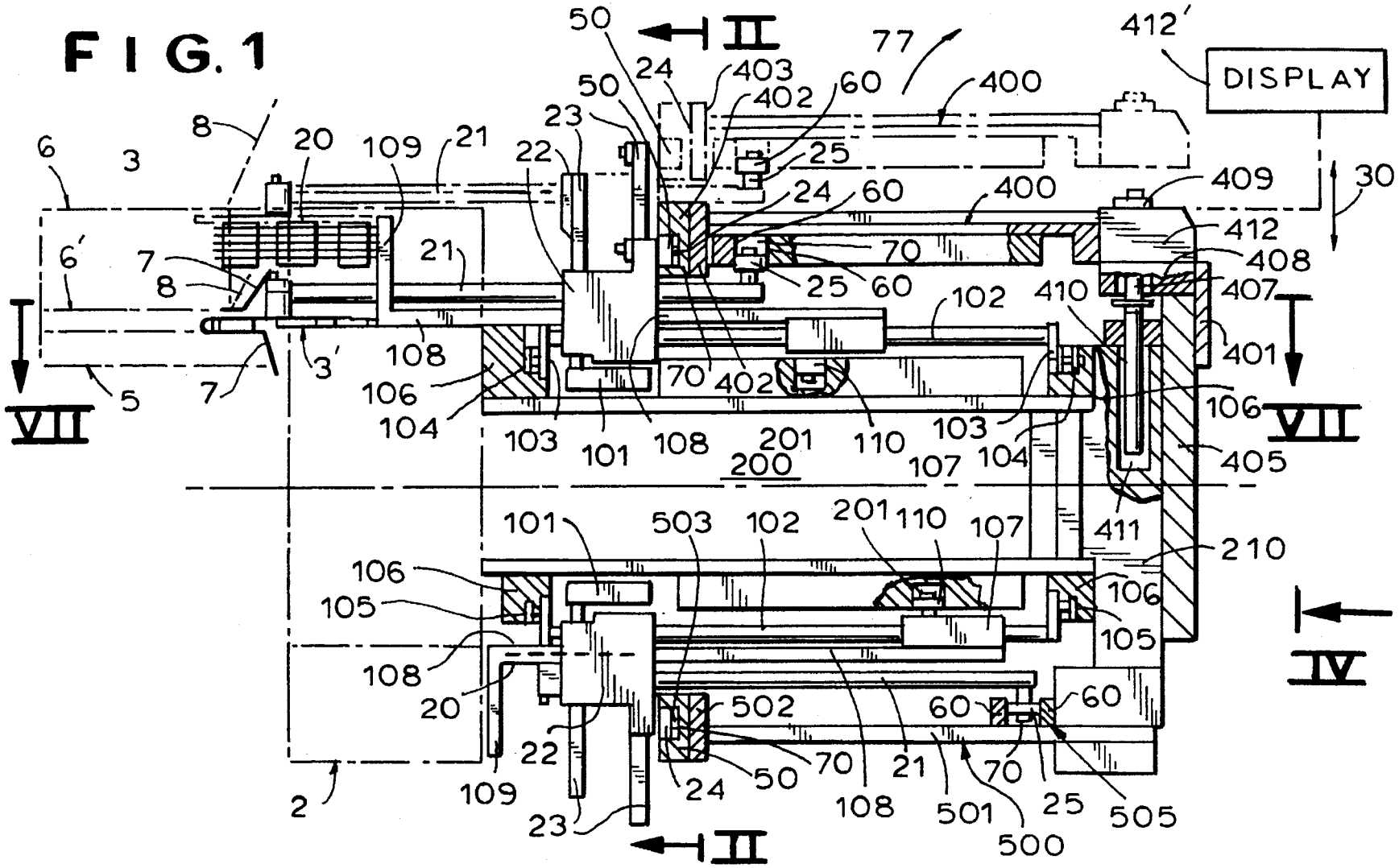
FIG. 1 is a cross sectional view through a packaging machine according to the invention with parts being shown schematically and other parts omitted for a quicker showing of the more essential parts which have been shown in solid lines in the drawing.

The apparatus shown in the drawing serves for the simultaneous insertion of a product to be packed, represented only schematically at 3,3' in FIG. 1, e.g. a stack of blister packs or a single blister pack, delivered by respective cells 1 (FIG. 7) of a product transport chain 2, and brochures 7 into containers 6, 6' in the form of erected folded boxes. The boxes 6, 6' are delivered to the insertion location in cells 4 of a container transport chain 5. The brochures 7 can be in the form of so-called bipack tickets which are also inserted with the product into the containers.

FIG. 1 shows in solid lines that the product 3' to be packed in each container 6' can be a single blister pack, while the dot-dash lines show the product 3 to be a stack of a plurality of blister packs and of which only the uppermost blister packs are visible. Correspondingly, FIG. 1 shows that the container 6' can be a low-height box in the first case, but a full height box 6 in the second case, adapted to accommodate the full stack of blister packs. A flap of the box is folded open to receive the product as shown at 8, 8', in FIG. 1. In other figures, for the sake of simplification, neither the products nor their containers have been illustrated.

To shove the products into the containers, insertion rams 108 are provided, these insertion rams being carried on an endless product insertion chain 10. The travel directions of the product transport chain 2, the product insertion chain 10 and the container transport chain 5 is indicated by the arrow 9. The three chains are all endless and, in the drawing, only the product insertion chain 10 has been shown fully. The product transport chain 2, the insertion chain 10 and the container transport chain 5 run parallel to one another and are synchronized with one another over the portion 400 of their stretches along which the process of inserting the product 3, 3' from the product conveyor 2 into the containers 6, 6' on the container conveyor 5 is effected.

The product insertion conveyor 10 comprises carriages 100 which run along the side of the product conveyor 2 turned away from the container conveyor 5. Each of these carriages 100 in the exemplary embodiment shown, comprises a common base 101 for two guide rods 102 connected with one another in the circumferential direction by chain links 103. The chain links 103 are guided on rollers 104 running in guide grooves 105 of guide rails 106 on a fixed body or machine chassis or base 200.

While the drive of the chain 10 formed by the interlinked carriages 100 and links 103 has not been illustrated in the drawing, it is effected in any case synchronously with the drive for the product chain 2 and the container chain 5, e.g. via the same drive and return shafts or via shafts which are coupled together. On the carriages 100 and, more specifically, on the guide rods 102 of each carriage, there is a slider 107 guided on the guide rods and which carries the respective insertion ram 108 for introducing the product 3, 3' into the container 6, 6'. Each ram 108 has a ram head 109, of a height equal at least to the maximum height of the product to be inserted into a box by the machine, i.e. of a height equal to the greatest possible height of a stack of packages to be boxed.

The insertion movement of the slider 107 and ram 108 is controlled by the carriage travel. For this purpose, the slider 107 has a cam-follower roller 110 engaging in a camming groove 201 forming a slave cam in the chassis 200, the slave cam extending along the path of the slider 107.

The brochures 7, which are fed by means not shown to the mouth of the container into which the product is to be inserted, are entrained by means of the product 3, 3' into the container 6, 6' as is shown in FIG. 1 for the entrainment of a bipack ticket 7 by the single blister strip 3'. During this transfer of the product 3, 3' and brochure 7 into the container 6, 6', the product is engaged from above by a hold-down tongue 20 so that, for example, bowed blister packs can be pressed flat and bowing by the pressure of the ram 108 can be excluded. These hold-down tongues 20 are arranged on hold-down rams 21 parallel to the insertion rams 108 and shiftable longitudinally in parallel and synchronously with the carriages 100 on sliders 22.

Figure 2:
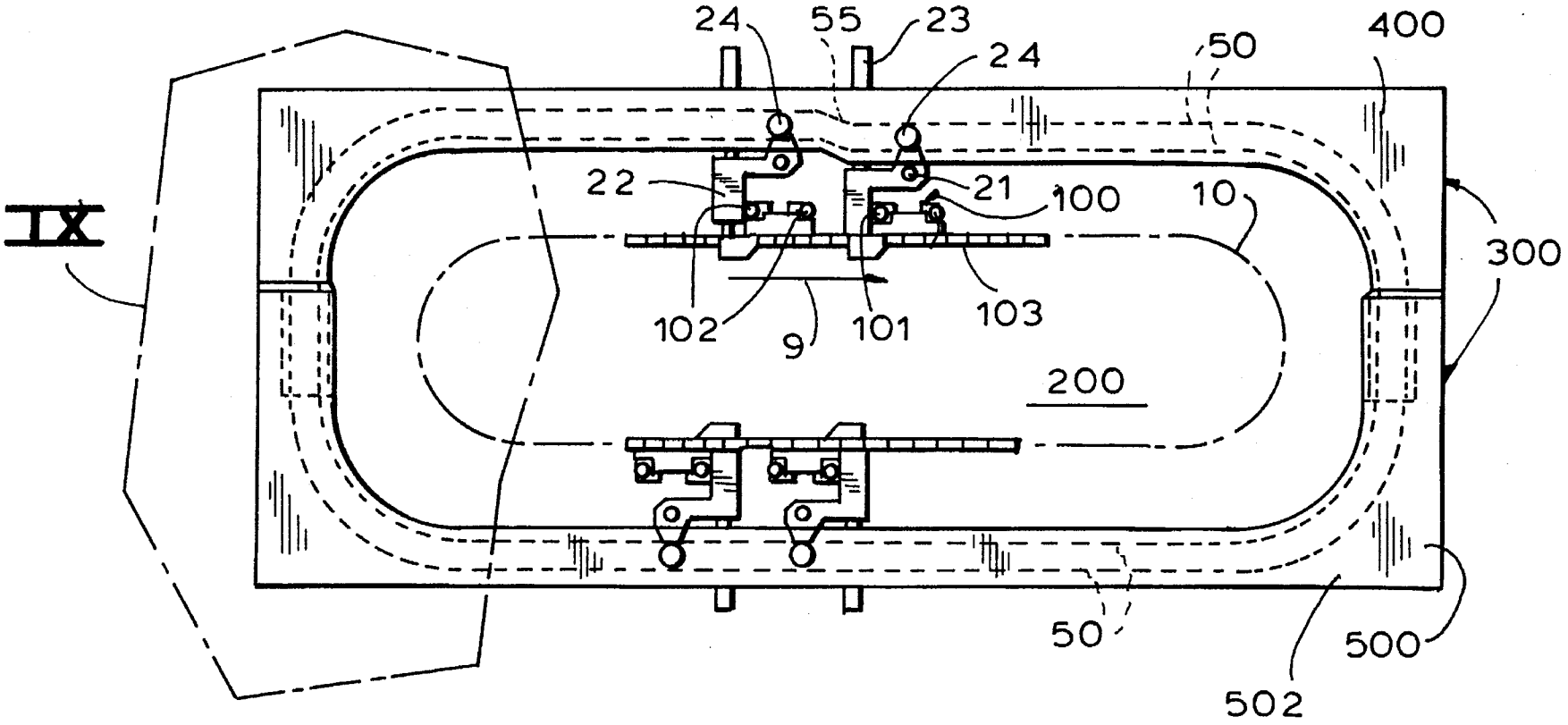
FIG. 2 is a cross sectional view taken along line II—II of FIG. 1 with certain parts omitted to more clearly illustrate the structure important to this invention.

These slides 22 travel together with the carriages 100 along the endless path of the latter. To this end the brackets 101 of the carriages 100 each have two guide columns or posts 23 which extend perpendicular to the direction of movement of the carriages 100 and to the longitudinal directions of the hold-down rods 21. One of the slides 22 is thus guided on the guide posts 23 of each carriage 100 (FIG. 1–3) so that the positions of the slides 22 can be controlled as a function of the carriage travel.

Figure 10:
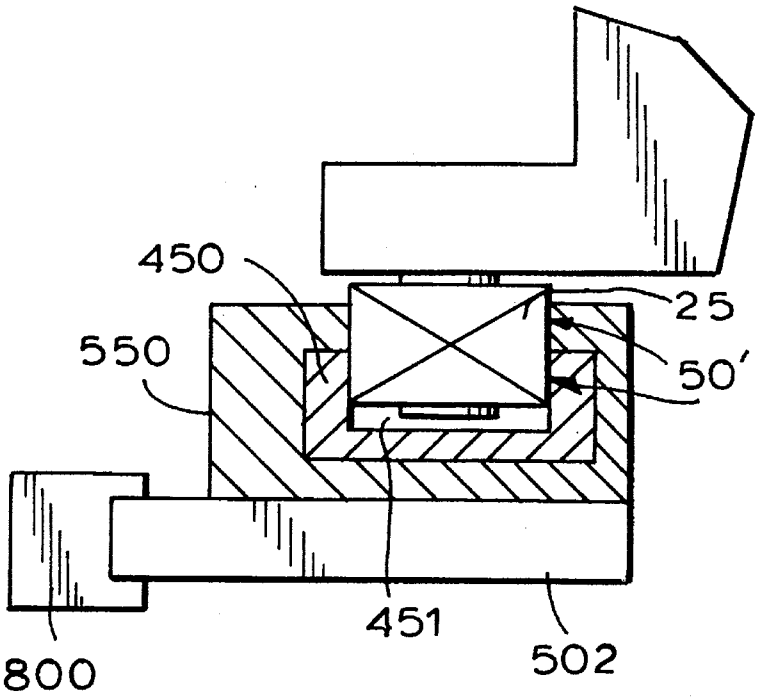
FIG. 10 is a section taken along the line X—X of FIG. 9.
Figure 5:
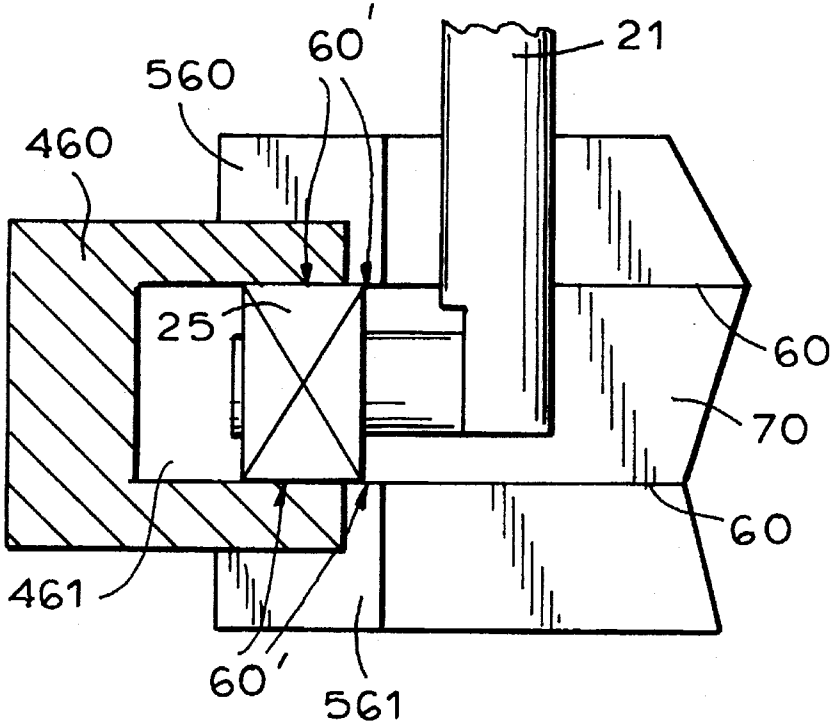
FIG. 5 is a section taken along the line V—V of FIG. 4.

Each slide 22 has a respective cam-follower roller 24 (FIG. 1) traveling in a closed cam track (FIGS. 2, 3 and 10), represented at 50. The cam track 50 is provided on a cam carrier generally represented at 300 and which is stationary relative to the travel of the slides 23 along their endless path determined by the cam 50.

The cam carrier 300 also has a closed or endless cam 60 in which respective cam follower rollers 25 engage, the cam follower rollers 25 being provided at the right-hand ends of the hold-down rods 21. The cam 60 thus controls the longitudinal shifting of the rods 21 during the travel of the carriages 100 and the slides 23 along their endless paths and the cams 50 and 60 thus follow the travel path 10 of the carriages 100 over the entire length of this travel path. Both cams are preferably slave cams.

The cam carrier 300 is comprised of two parts (FIGS. 2 and 3) including an upper cam carrier part 400 defining the portion 11 of the stretch of the first cam 50 and the second cam 60 and which is vertically shiftable on the base 200 of the machine so that its position can be varied to accommodate the height of the product 6, 6', i.e. for size changes. This change in height is effected relative to the travel over this portion 11 of the path of the carriages and is represented by the double-headed arrows 30 in FIGS. 1 and 3.

The stroke of the rods 21 in their longitudinal direction is sufficient to accommodate the stroke of the pusher on each carriage 100, i.e. the stroke necessary to displace the product 3, 3' into the container 6, 6' and an additional stroke at least equal to the width of the product transport chain 2 so that the hold-down tongues 20 can be withdrawn completely from the product-transport chain 2 and will avoid collision therewith in the fully retracted position of the tongues. This fully retracted position can be seen at the bottom of FIG. 1 along the return stretch of the chains. The insertion ram 108 and the hold-down rods 21 thus should have at least equal maximum strokes.

The lower cam-carrier part 500, which is fixed to the base 200 of the machine, comprises an elongated plate 501 and a girder 502 alongside product transport chain 2. On this longitudinal girder 502, the cam track 503 is mounted along the side turned away from the longitudinal plate 501, the track 503 constituting or forming the cam 50 for positioning the slides 22.

A cam 60 for controlling the displacement of the rods 21 is subdivided into three cam segments rigidly connected with the longitudinal plate 501, namely, two end segments or cam parts 504 and an intermediate segment or cam part 505 disposed between them.

The upper, adjustable-height cam-carrier part 400 is comprised of a frame formed by a rear longitudinal girder 501 and a front longitudinal girder 502 which are connected at their ends by respective transverse girders or beams 404. The rear girder 401 is rigidly connected to a shifter portion 405 which is shiftable on linear guides 406 of the stand 210 secured to the base 200. The shifting is effected by means of a height-adjustment spindle 407 which is rotatable and axially unshiftable in a support block 408 rigidly connected with the rear girder 401 and the shifter part 405 and can be rotated via its spindle head 409 which projects upwardly (FIG. 1).

The screw of the height-adjusting spindle 407 engages in a spindle nut 410 braced against the stand 210. In the stand 210 there is also provided a bore 411 coaxial with the spindle nut 410 and which receives the portion of the spindle 407 extending through the nut. When the threaded spindle 407 is rotated, therefore, in the nut 410 which is held against rotation, the upper cam carrier part 400 is either raised or lowered depending upon the sense of rotation. In solid lines in FIG. 1 the lower position of this part has been illustrated, corresponding to the product 3' to be packaged, while in dot-dash lines, the uppermost position of part 400 has been shown, corresponding to the product 3 to be packaged.

To enable detection of the precise setting of the cam-carrier part 400, a sensor 412 is connected to the movable cam-carrier part or is provided on the movable cam-carrier part (FIG. 1) and is responsive to rotation of the spindle, to transmit the measurement to a display 412' shown diagrammatically in FIG. 1.

At the front girder 402 of the upper cam carrier 400, a cam track 403 is mounted on which the cam 50 for the positioning of the slides 22 is formed or provided.

The cam 60 for the displacement of the rods 21 is formed from a plurality of cam-track segments or parts, namely two end cam segments or parts 420 between which further cam segments 421, 422, 450 are disposed and as will be further described.

These cam segments 420, 421, 422 and 450 are connected with the upper cam-carrier part 400 and thus are adjustable therewith in height when the height-adjustment spindle 407 is rotated. When the upper cam-carrier part 400 is adjusted for a size change by actuation of the height-adjusting spindle 407, there is a corresponding lifting of the upper stretches of the cams 50 and 60 and the guide grooves 70 formed thereby to accommodate the new size of the product to be packaged beneath the tongues and thus an adjustment of the level of the path of the slides 22 and the rods 21 along the guide columns or posts 23. The size change is thus effected only by actuation of the height-adjusting spindle 407. Further adjustments are not required.

Figure 3:
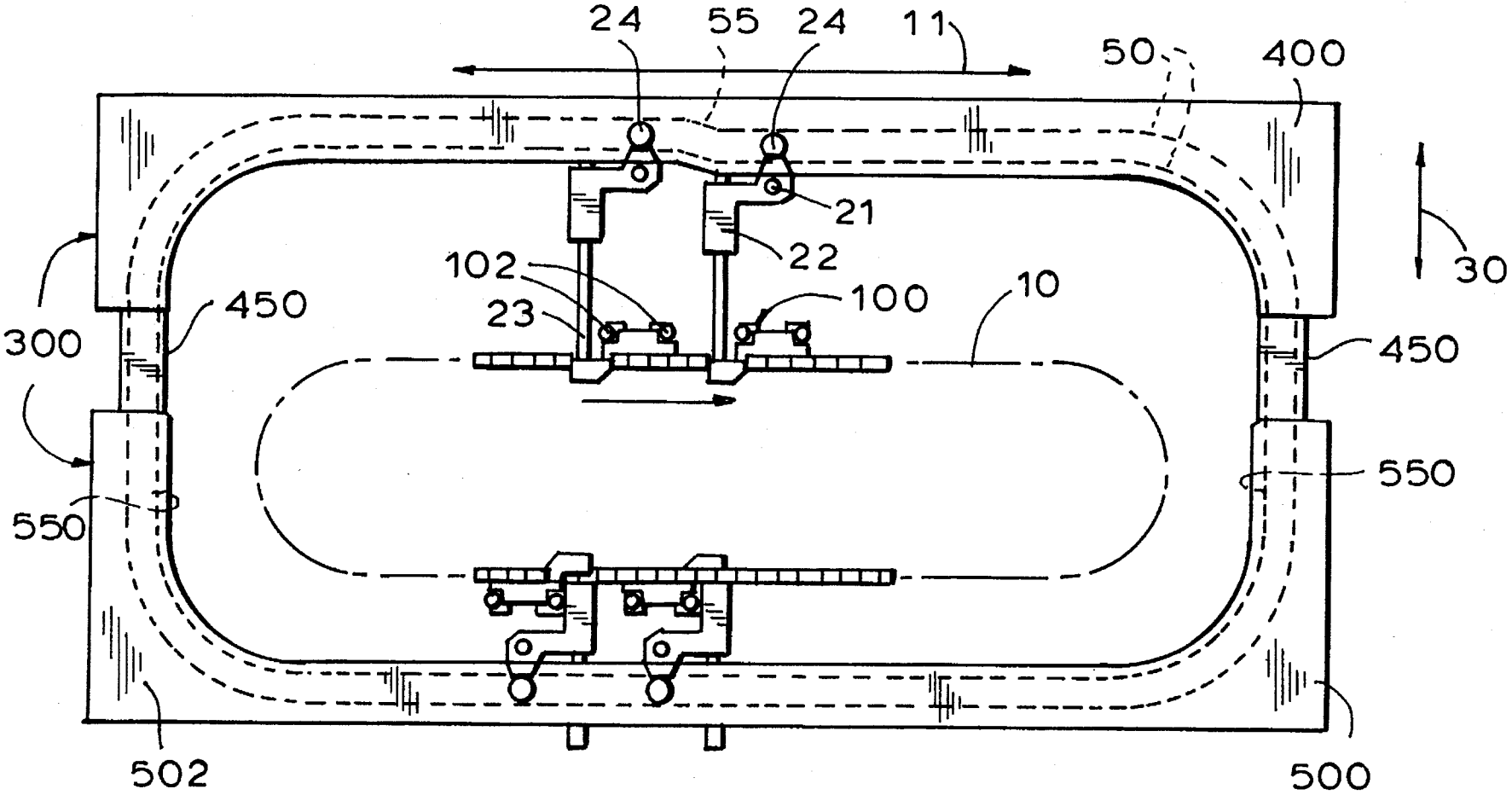
FIG. 3 is a view similar to FIG. 2 showing different relative positions of the two cam carrier parts.

So that no gaps form in the height adjustment of the upper cam-carrier member 400 between the two cam-carrier parts 400, 500, for the cam-follower rollers 24 and 25, there are provided between the two cam-carrier parts, connecting portions 450, 550 and 460, 560 bridging the cam-carrying parts 400, 500 and connecting the respective cam end segments 403, 503 or 420, 504 (see FIG. 3 for example).

These connecting pieces or bridge pieces overlap the cam-carrying parts in which they are mounted and thus telescope with respect to them. They provide flush transitions for the cam-follower rollers over the junctions and these bridge pieces with the respective cam-carrying parts.

For example, the connecting pieces 450, 460 at the adjustable upper cam-carrying part 400 have U-shaped cross section portions 451, 461 which engage in U-section sockets 551, 561 of the respective connecting parts 550, 560 at the lower, stationary cam-carrying part 500.

The cams 50 and 60 have surfaces 50', 60' which lie flush with one another at the junctions 450, 550 or 460, 560 in the axial directions of the cam-follower rollers 254, 25. The axial dimensions of the cam-follower rollers 24, 25 are sufficient to ensure that these rollers will ride over both surfaces 50', 60' when they meet the transition regions.

The cam 60 and cam 50 are each formed from the lateral flanks or side walls of a guide groove 70 so that each cam-follower roller is slaved to follow the groove 70 and is positively displaced in accordance with the configuration of the cam groove during the travel of the carriages 100 along the closed path.

Figure 9:
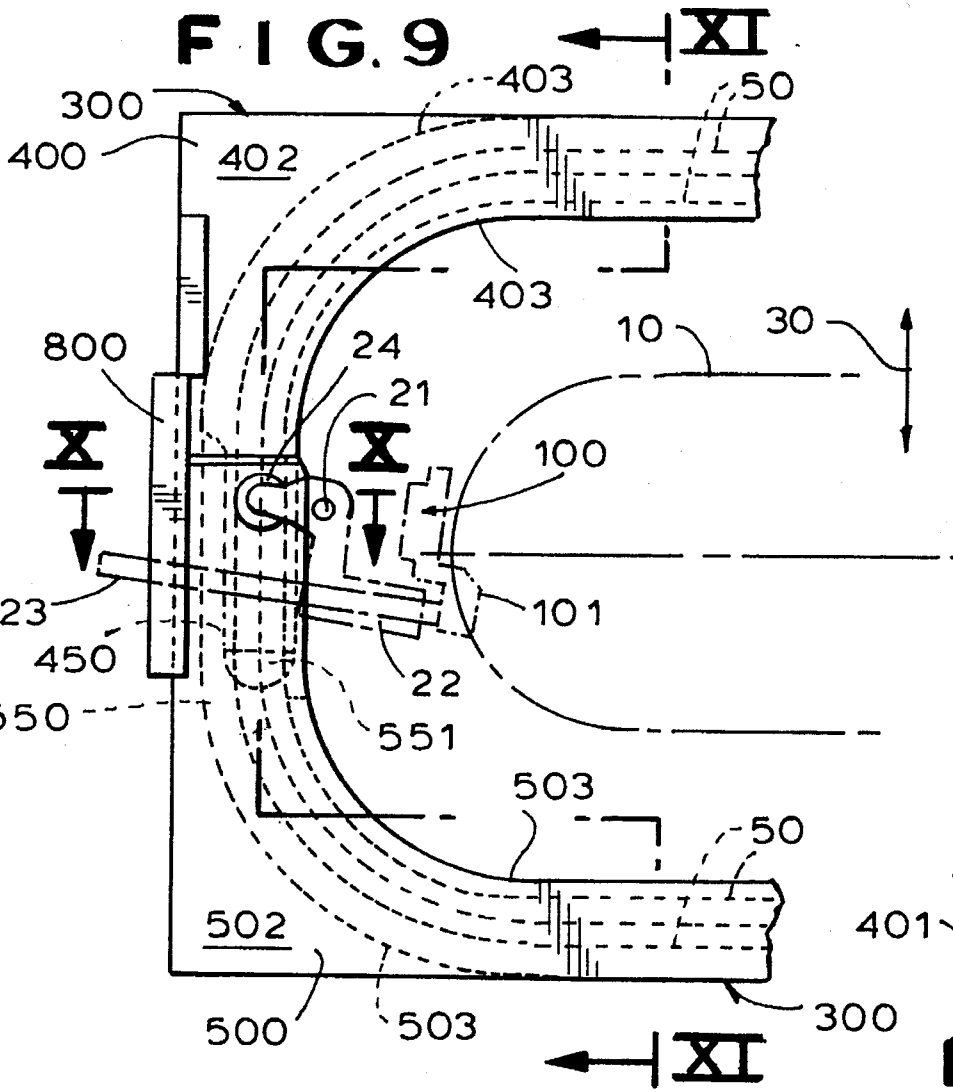
FIG. 9 is a detail view of region IX of FIG. 2 drawn to a larger scale but illustrating only a single carriage or slide.
Figure 11:
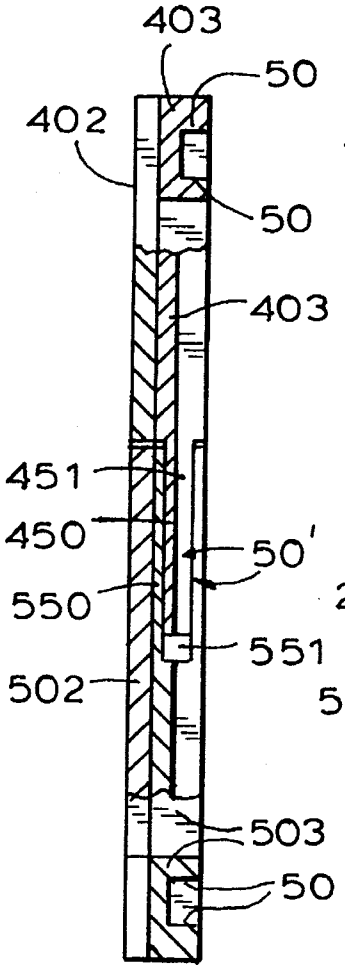
FIG. 11 is a section taken along the line XI—XI of FIG. 9.

In addition to the connecting pieces or transitions 450, 550 and 460, 560, the girders 402 and 502 at the transition regions can be telescopingly slidable on one another (see FIGS. 9 and 10), where they are bridged by correspondingly shaped bars 800. More particularly, the front girder 402 of the upper cam-carrier part 400 can be fixed with the profile bar 800 in a guide recess of which the front girder 502 of the lower cam-carrier part 500 is guided.

Figure 4:
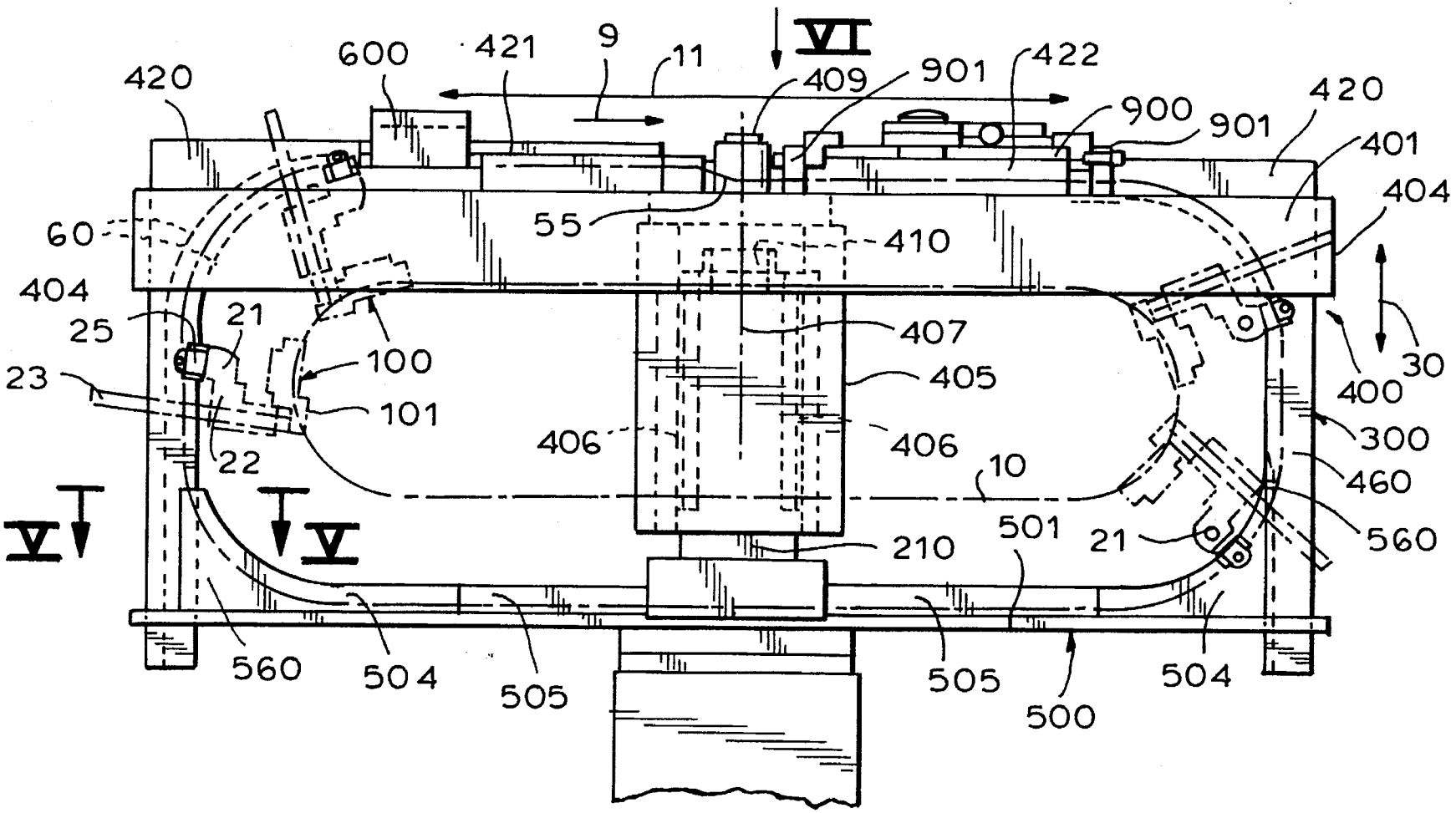
FIG. 4 is an elevational view taken in the direction of arrow IV of FIG. 1 illustrating only one of the carriages and slides.

In the upper adjustable cam-carrier part 400, the cam 50 is formed with a dip 55 by means of which a parallel shifting of the slides 22 in the direction of the carriages 100 is effected. The carriages travel in the clockwise sense (arrow 9 in FIG. 4) along their endless path (see also FIGS. 2 and 3). This dip 55 in the cam 50 is at a location of the portion 11 of the path at which the rods 22 with the hold-down tongues 20 are disposed above the product 3, 3' before the product has been shifted into the box 6 or 6', i.e. a region at which the product is engaged by the hold-down tongues at the entrance to the box in which the product is to be packaged.

This ensures that the package will be pressed downwardly before shifting of the product into the box begins. So that, during this dip of the slides 22, the cam-follower roller 25 does not escape from the cam 60, the cam-follower roller in the axial direction and the cam 60 in this direction have a width (and the groove 70 has a depth) that is at least equal to the parallel shifting of the slides by this dip.

The cam 60 is formed on the upper adjustable cam-carrier part 400 in succession along the cam previously mentioned, cam segments 420, 421 and 422. At the product-insertion segment of the curve, the cam has two fixed cam segments 421 and 522 and a replaceable sizing part 450.

Figure 6:
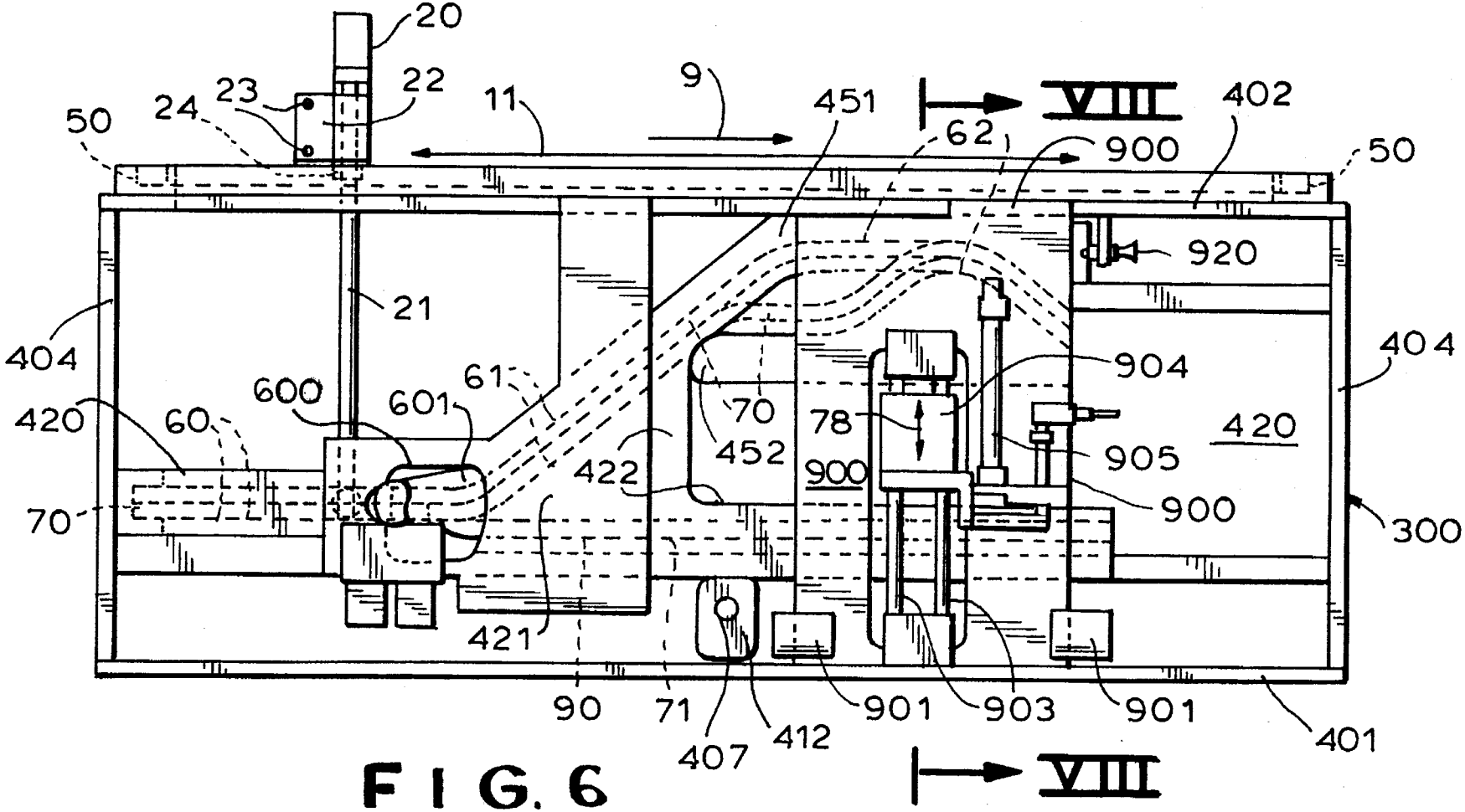
FIG. 6 is a plan view in the direction of arrow VI of FIG. 4 but showing only a single hold-down rod.

The segment 420 at the left-hand end, connected to the first fixed segment 421 can be provided with a branch track 600 for the cam-follower rollers 25 which has a branching tongue 601 inserted between the cam segments 61 and 62, and a deflection cam 90 associated therewith. Only one cam roller 25 has been shown in FIG. 6 as an example and controls the respective hold-down rod 21 during travel of the carriage in the direction represented by the arrow 9 across the branching tongue 601 which deflects the cam-follower roller to the cam segment 61, 62 or the groove 71 formed in the bypass cam 90.

Both grooves 70, 71 are connected to the segment 421 connected with cam segment 422 to return the cam-follower roller to its customary position.

Between the end cam segment 420 and the cam segment 422 at the right hand side, the sizing piece 450 is provided in which the product shifting movement is followed by the rod 21 in response to the cam 60.

While all of the previously mentioned cam segments 420, 410, 422 are fixed to the adjustable cam-carrying part 400, the sizing part 450 is replaceable so that it can be easily exchanged by another similarly disposed but shorter part for lower product sizes when the dimensions of the products 3, 3' in the insertion direction are to be changed and the stroke of the rods 21 are to be correspondingly adjusted.

Figure 8:
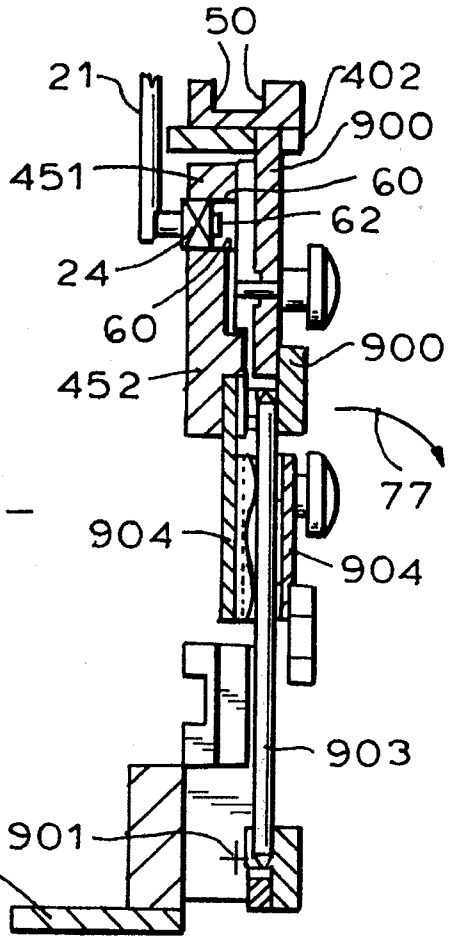
FIG. 8 is a section along the line VIII—VIII of FIG. 6.

So that these sizing parts 450 will be readily accessible for replacement, they can be mounted on a pivotal plate 900 swingable about an axis 901 in the direction shown by the arrow 77 in FIGS. 1 and 8.

The pivot axis 901 runs parallel to the direction of movement of the carriages 100 and is secured by detent pins 902 in the pivotal position illustrated in the drawing and in which the sizing part 450 defines the section 62 of the cam 60 and is thus flush with the neighboring cam segments 422, 420.

Usually the sizing part 450 will be subdivided along the cam 60 and transverse to the longitudinal direction of the hold-down rod 21. The portion 451 of the sizing part turned toward the product 3, 3' is fixed to the pivotal plate 900. The portion 452 of the sizing part 450 turned away form the product 3, 3' is shiftable in the direction of the double-headed arrow 78 on guide rods 903 via an overload carriage or slider 904, the guide rods 903 being parallel to the longitudinal dimension of the hold-down rods 21. The guide rods 903 are mounted on the pivot plate.

The overload carriage or slider 904 is pressed by the force of a spring element 905, for example a fluid-pressurized cylinder, in a direction toward the product and is resiliently held in position against this force.

If travel of the cam-follower rollers in the section 62 of the cam 60 formed by the sizing part 450 is blocked, e.g. by blockage of the product, such that the product cannot be displaced into the box 6 or 6', the overload carriage 904 with its rear part 452 can move rearwardly to prevent any damage.

The branch 600 in the cam segment 421 allows individual insertion portions to be canceled by duplicating the respective cam-follower rollers 25 to the bypass 90, when, for example, a change in the sizing part 450 is desired or required. This deflection of cam-follower rollers to the bypass then frees the sizing part 450 from cam-follower rollers. The bypass cam-follower roller can return to a downstream portion of the cam 60 in a manner which has not been illustrated.

Figure 7:
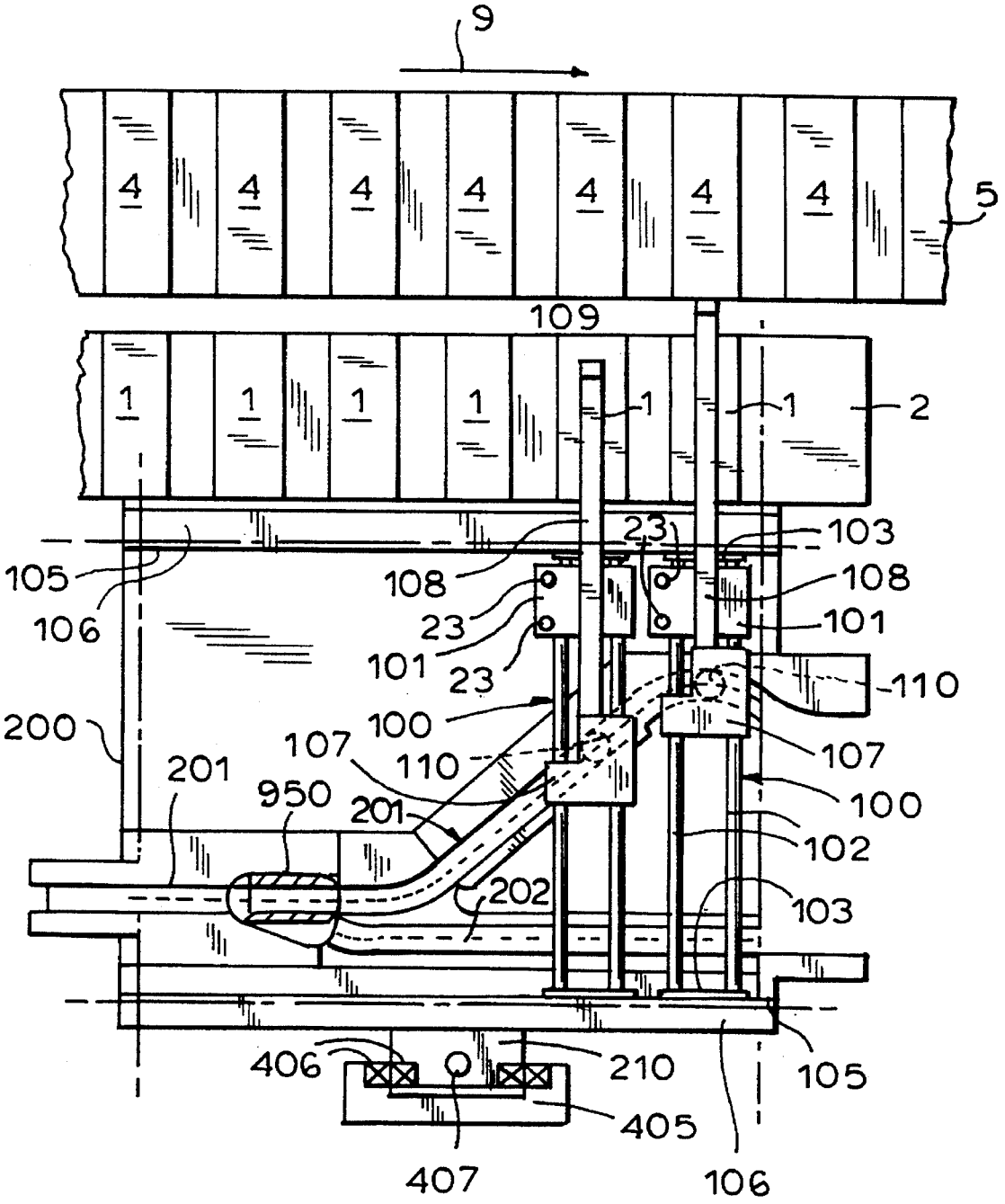
FIG. 7 is a section along the line VII—VII of FIG. 1 showing only two carriages.

A second branch 950, which corresponds to the branch 900 of the cam 60, can be provided as shown in FIG. 7 for the cam-follower roller 110 along the camming grove 201 for the product shifter 108, allowing cam-follower rollers 110 to travel along bypass groove 202 when the displacement of the product into the containers is to be interrupted.

We claim:

1. An apparatus for the simultaneous introduction of a product and a packaging insert into a box-shaped container, comprising:

an endless product transport chain carrying a succession of products to be packaged in said containers;

an endless container transport chain disposed on one side of said product transport chain and carrying a succession of said containers for receiving said products and inserts;

an endless product pusher chain disposed on an opposite side of said product transport chain, said chains having mutually parallel stretches synchronized for movement at least over a region at which a product from said product transport chain is inserted together with an insert into a respective container, said product pusher chain comprising:

a plurality of interlinked carriages, a respective pusher ram shiftable on each carriage and shiftable transversely to the movement of said chains in said region and aligned with a product on said product transport chain and with a container on said container transport chain for shifting the respective product into the respective container, and at least one guide column formed in each of said carriages;

hold-down means for engaging said products and including:

a respective hold-down tongue at each carriage engageable with a respective product from above during shifting of the respective product, a respective hold-down rod shiftable parallel to the transverse shift of said pusher ram and carrying the respective hold-down tongue, a respective slider assigned to each carriage, movable parallel to the movement of the carriages with the product pusher chain and synchronously with said carriages at least in said region, said slider slidably receiving the respective hold-down rod, the sliders having a circulating path and each being provided with a cam-follower roller engaged in a first slave cam extending in a closed path along said circulating path, said sliders being guided on said columns for movement perpendicular to the shift of said rods and said carriages with the product pusher chain in said region, a respective cam-follower roller on each of said hold-down rods engaged in a second slave cam for controlling the respective hold-down tongue, said cams following a path of said carriages over the length thereof, a common cam carrier for said cams, said cam carrier being subdivided into at least two parts, at least one of said parts extending over said region, adjusting means operatively connected to said one of said parts for shifting same in a direction perpendicular to the shift of said rods and to the direction of movement of said carriages in said region for adjusting said tongues to different product sizes, said rods having an insertion stroke which is greater than a stroke of the pusher ram by at least a width of the product transport chain; and means for positioning said inserts ahead of said pusher rams in said region.

2. The apparatus defined in claim 1, further comprising connecting pieces between said parts interconnecting respective portions of said cams to maintain continuity thereof and overlapping said cams by at least a distance corresponding to adjustability of said one of said parts relative to the other of said parts.

3. The apparatus defined in claim 2 wherein at a junction of at least one of said parts with one of said connecting pieces, the respective connecting piece has a U-shaped cross section received in a U-shaped cross section of the respective part, the respective cam-follower roller having a width such that it rides upon opposing surfaces of both of the cross sections in traversing said junction.

4. The apparatus defined in claim 1 wherein said first cam is formed in said one of said parts with a dip causing a parallel shifting of said sliders relative to said carriages, said dip being located at a portion of said region at which the respective tongues are disposed above the products before the products have been inserted into the containers, the second cam having a width in a direction of axes of the respective cam-follower rollers at least equal to the parallel shifting of the sliders by said dip.

5. The apparatus defined in claim 1 wherein said cams are so formed that the respective cam-follower rollers are constrained to follow said cams without substantial play over entire lengths of said cams.

6. The apparatus defined in claim 5 wherein each of said cams is formed by opposite flanks of a respective guide groove receiving the respective cam-follower roller.

7. The apparatus defined in claim 1 wherein each of said carriages is formed with a pair of said guide columns.

8. The apparatus defined in claim 1 wherein said adjusting means includes a height-variable spindle interposed between said parts.

9. The apparatus defined in claim 1, further comprising a sensor operatively connected with said one of said parts for detecting an adjustment setting of said one of said parts, and a display connected with said sensor for displaying said setting.

10. The apparatus defined in claim 1 wherein at least a portion of said second cam is formed of a replaceable element, further comprising mounting means for removably mounting said element on at least one of said parts.

11. The apparatus defined in claim 10 wherein said element is carried by a pivotal plate swingable about a pivot axis parallel to the direction of movement of said carriages, further comprising an indexing pin for locking said plate in a respective position in which said element is flush with the remainder of said second cam.

12. The apparatus defined in claim 11 wherein the element is subdivided along the second cam and transverse to said rods with one portion turned away from the product disposed on an overload slide shiftable in a longitudinal direction of said rods on said plate.

13. The apparatus defined in claim 12, further comprising a resilient member bearing upon said overload slide for holding it in a working position.

14. The apparatus defined in claim 13 wherein said resilient member is a fluid-pressurized cylinder.

15. The apparatus defined in claim 1 wherein said second cam has, at a start of said region, a branch at which a deflection cam is formed with segments opening from and into said second cam at opposite ends of said deflection cam.

16. The apparatus defined in claim 1 wherein said product transport chain has cells receiving stacks of blister packs forming said products.

* * * * *